US008366891B2

(12) United States Patent
Nguyen

(10) Patent No.: US 8,366,891 B2
(45) Date of Patent: Feb. 5, 2013

(54) METALLIC OXYGEN EVOLVING ANODE OPERATING AT HIGH CURRENT DENSITY FOR ALUMINUM REDUCTION CELLS

(75) Inventor: Thinh Trong Nguyen, Onex (CH)

(73) Assignee: Rio Tinto Alcan International Limited, Montreal, QC (CA)

( * ) Notice: Subject to any disclaimer, the term of this patent is extended or adjusted under 35 U.S.C. 154(b) by 96 days.

(21) Appl. No.: 13/062,636

(22) PCT Filed: Sep. 1, 2009

(86) PCT No.: PCT/EP2009/061257

§ 371 (c)(1), (2), (4) Date: Apr. 28, 2011

(87) PCT Pub. No.: WO2010/026131

PCT Pub. Date: Mar. 11, 2010

(65) Prior Publication Data

US 2011/0192728 A1 Aug. 11, 2011

(51) Int. Cl.
*C25B 11/04* (2006.01)
*C25B 11/06* (2006.01)
*C25C 3/12* (2006.01)

(52) U.S. Cl. ..... 204/293; 204/291; 204/292; 204/243.1; 204/247.3; 205/385; 205/386; 205/387

(58) Field of Classification Search ..... 204/291, 204/292, 293, 243.1, 247.3; 205/372, 385, 205/386, 387
See application file for complete search history.

(56) References Cited

U.S. PATENT DOCUMENTS

| | | | | |
|---|---|---|---|---|
| 4,871,438 | A | 10/1989 | Marschman et al. | |
| 4,960,494 | A | 10/1990 | Nguyen et al. | |
| 5,510,008 | A * | 4/1996 | Sekhar et al. | 205/384 |
| 5,865,980 | A * | 2/1999 | Ray et al. | 205/367 |
| 6,372,119 | B1 * | 4/2002 | Ray et al. | 205/387 |
| 6,416,649 | B1 * | 7/2002 | Ray et al. | 205/387 |
| 6,423,195 | B1 * | 7/2002 | Ray et al. | 204/291 |
| 6,423,204 | B1 * | 7/2002 | Ray et al. | 205/387 |
| 6,436,272 | B1 * | 8/2002 | Brown et al. | 205/374 |
| 6,521,115 | B2 * | 2/2003 | Duruz et al. | 205/387 |
| 6,562,224 | B2 * | 5/2003 | Crottaz et al. | 205/384 |
| 6,719,889 | B2 * | 4/2004 | Brown | 205/230 |
| 6,821,312 | B2 * | 11/2004 | Ray et al. | 75/233 |
| 6,878,247 | B2 * | 4/2005 | Duruz et al. | 204/293 |
| 7,033,469 | B2 * | 4/2006 | Weirauch et al. | 204/291 |
| 2001/0019017 | A1 * | 9/2001 | Duruz et al. | 204/290.01 |
| 2001/0027923 | A1 * | 10/2001 | Nora et al. | 205/384 |
| 2002/0056650 | A1 * | 5/2002 | Ray et al. | 205/387 |
| 2003/0066755 | A1 * | 4/2003 | Duruz et al. | 205/221 |
| 2003/0226760 | A1 * | 12/2003 | Duruz et al. | 205/373 |
| 2004/0216995 | A1 * | 11/2004 | Nguyen et al. | 204/243.1 |
| 2005/0087916 | A1 * | 4/2005 | Easley et al. | 264/611 |
| 2005/0178658 | A1 | 8/2005 | Nguyen et al. | |
| 2005/0194066 | A1 * | 9/2005 | Duruz et al. | 148/241 |
| 2005/0205431 | A1 * | 9/2005 | Nguyen et al. | 205/372 |
| 2005/0269202 | A1 * | 12/2005 | De Nora et al. | 204/243.1 |
| 2011/0031129 | A1 * | 2/2011 | de Nora | 205/372 |

FOREIGN PATENT DOCUMENTS

| | | | |
|---|---|---|---|
| WO | 00/06803 | A1 | 2/2000 |
| WO | 03/078695 | A2 | 9/2003 |
| WO | 2004/018082 | A1 | 3/2004 |
| WO | 2004/074549 | A2 | 9/2004 |
| WO | 2004/082355 | A2 | 9/2004 |
| WO | 2005/068390 | A1 | 7/2005 |
| WO | 2005/090641 | A2 | 9/2005 |
| WO | 2005/090642 | A2 | 9/2005 |
| WO | 2005/090643 | A2 | 9/2005 |

OTHER PUBLICATIONS

International Search Report and Written Opinion mailed Jun. 11, 2010 (PCT/EP2009/061257); ISA/EP.

* cited by examiner

*Primary Examiner* — Bruce Bell
(74) *Attorney, Agent, or Firm* — Banner & Witcoff, Ltd.

(57) ABSTRACT

A metallic oxygen evolving anode for electrowinning aluminum by decomposition of alumina dissolved in a cryolite-based molten electrolyte, and operable at anode current densities of 1.1 to 1.3 A/cm2, comprises an alloy of nickel, iron, manganese, optionally copper, and silicon. Preferably, the alloy is composed of 64-66 w % Ni; Iron; 25-27 w % Fe; 7-9 w % Mn; 0-0.7 w % Cu; and 0.4-0.6 w % Si. The weight ratio Ni/Fe is in the range 2.1 to 2.89, preferably 2.3 to 2.6, the weight ratio Ni/(Ni+Cu) is greater than 0.98, the weight ratio Cu/Ni is less than 0.01, and the weight ratio Mn/Ni is from 0.09 to 0.15. The alloy surface can comprise nickel ferrite produced by pre-oxidation of the alloy. The alloy, optionally with a pre-oxidized surface, can be coated with an external coating comprising cobalt oxide CoO.

16 Claims, 4 Drawing Sheets

METALLIC OXYGEN EVOLVING ANODE OPERATING AT HIGH CURRENT DENSITY FOR ALUMINUM REDUCTION CELLS

CROSS-REFERENCE TO RELATED APPLICATIONS

The present application is a U.S. National Phase filing of International Application No. PCT/EP2009/061257 filed on Sep. 1, 2009, designating the United States of America and claiming priority to International Application No. PCT/IB2008/053619, filed on Sep. 8, 2008, both of which applications the present application claims priority to and the benefit of, and both of which applications are incorporated by reference herein in their entireties.

FIELD OF THE INVENTION

This invention relates to the electrowinning of aluminium by decomposition of alumina dissolved in a molten fluoride-containing electrolyte using metallic oxygen evolving anodes.

BACKGROUND OF THE INVENTION

In aluminum electrowinning process by decomposition of alumina dissolved in molten cryolite, the replacement of carbon anodes by oxygen evolving anodes permits to suppress the production of about 1.5 tons of $CO_2$ per ton of metal. However, from thermodynamic considerations, oxygen evolving anodes potentially present, compared to carbon anodes, a theoretical penalty of 1.0 volt of the anode potential. Practically, this theoretical penalty could be reduced to about 0.65 volt thanks to the low oxygen over-potential of an appropriate active surface of the oxygen evolving anodes. This penalty of 0.65 volt represents an increase of about 15% of the energy consumption, and should be compensated by operating at an anode-cathode distance (ACD) lower than 4 cm to reduce the cell voltage.

However, thermodynamic calculations show that, at the same cell voltage and current, the thermal balance of a cell using oxygen evolving anodes is about 60% of that of a cell using conventional carbon anodes. By lowering the ACD, the thermal balance would be much less favourable for oxygen evolving anodes as the thermal equilibrium of the cells would not be respected any more.

Taking into account these energy penalties, operating with an important increase of the cell current could be envisaged as one solution to achieve acceptable economic and energetic conditions when operating aluminum reduction cells with oxygen evolving anodes. For the case of retrofitting in conventional commercial cells that have defined spaces for the cathodes and for the anodes, the oxygen evolving anodes must then be able to operate at high current densities in the range of 1.1 to 1.2 A/cm$^2$ corresponding to an increase of 30 to 50% of the values used for carbon anodes.

Oxygen evolving anodes used for aluminum reduction cells may be constituted of ceramic, cermet or metallic alloy bodies; and the anode surfaces may be totally or partially covered by an active layer composed of single phase or mixture of metallic oxides having preferentially a predominant electronic conductivity. In general these active metallic oxide layers belong to the class of semiconductors, preferably a p-type semiconductor that favours electron transfer from the electrolyte to the electrode with lowest activation over-potential in anodic polarization.

During operation at high temperature (920-970° C.) the composition of the oxide active layer of oxygen evolving anodes may be modified by:

- Chemical interactions of one or several components diffused from the substrate bodies to the surfaces;
- Selective dissolution of one or several components of the oxide layer in the cryolite melt; and/or
- Further oxidation interactions of one or several components by nascent or molecular oxygen formed at the anode surfaces.

Change of the composition or/and the ratios between different components of the oxide layer, combined with an increase of the oxygen activity generated at high current densities may lead to a modification of the semiconductor character of this active metallic oxide layer.

The local transformation of p-semiconductor phases into n-semiconductor phases may then increase the activation over-potential of the anode; or in the worse case may induce an unstable regime due to the semiconductor diodes formed by the n-p semiconductor junctions.

Such modification of the semiconductor character of the active oxide layer may be an obstacle impeding the operation of oxygen evolving anodes at a current density above a certain critical value.

So far all attempts to provide metallic oxygen evolving anodes that are capable of withstanding operation at high current densities have failed.

PRIOR ART PUBLICATIONS

WO 2000/006803 (Duruz J. J., De Nora V. & Crottaz O.) describes oxygen evolving anodes made of Nickel-Iron alloys with a preferential composition range of 60-70 w % Fe; 30-40 w % Ni and/or Co; optionally 15 w % Cr and up to 5 w % of Ti, Cu, Mo and other elements can be added. The active layer is formed from the resulting oxide mixture obtained by thermal treatment of the anode alloy at high temperature in oxidizing atmosphere.

WO 2003/078695 (Nguyen T. T. & De Nora V.) describes oxygen evolving anodes made of Nickel-Iron-Copper-Al alloys with a preferential composition range of 35-50 w % Ni; 35-55 w % Fe; 6-10 w % Cu; 3-4 w % Al. The preferred Ni/Fe weight ratio is on the range of 0.7-1.2. Optionally 0.2-0.6 w % Mn can be added. The active layer is formed by the resulting oxide mixture obtained by thermal treatment of the anode alloy at high temperature in an oxidizing atmosphere.

WO 2004/074549 (De Nora, Nguyen T. T. & Duruz J. J.) describes oxygen evolving anodes made of a metallic alloy core enveloped by an external layer or coating. The internal metallic alloy core may contain preferentially 55-60 w % Ni or Co; 30-35 w % Fe; 5-9 w % Cu; 2-3 w % Al; 0-1 w % Nb and 0-1 w % Hf. The external metallic layer or coating may contain preferentially 50-95 w % Fe; 5-20 w % Ni or Co and 0-1.5 w % of other elements. The active layer is formed the resulting oxide mixture obtained by thermal treatment of the anode alloy at high temperature in oxidizing atmosphere.

WO 2005/090643 & 2005/090641 (De Nora V. & Nguyen T. T.) describe oxygen evolving anodes having a CoO active coating on a metallic substrate. The composition and the thermal treatment conditions of the Cobalt precursor in the external coating are specified to inhibit the formation of the undesirable phase of $CO_3O_4$.

WO 2005/090642 (Nguyen T. T. & De Nora V.) describes oxygen evolving anodes with a cobalt-rich outer surface on a substrate made of at least one metal selected from chromium, cobalt, hafnium, iron, nickel, copper, platinum, silicon, tungsten, molybdenum, tantalum, niobium, titanium, tungsten, vanadium, yttrium and zirconium. In an example the composition is 65 to 85 w % nickel; 5 to 25 w % iron; 1 to 20 w % copper; and 0 to 10 w % further constituents. For example, the substrate alloy contains about: 75 w % nickel; 15% iron; and 10 w % copper.

WO 2004/018082 (Meisner D., Srivastava A.; Musat J.; Cheetham J. K. & Bengali A.) describes composite oxygen evolving anodes consisting of a cast nickel ferrite cermet on a metallic substrate. The cermet envelope is composed of 75-95 w % $NiFe_2O_4$ mixed with 5-25 w % Cu or Cu—Ag alloy powders. The metal based substrate is made of Ni. Ag, Cu, Cu—Ag or Cu—Ni—Ag alloys.

U.S. Pat. No. 4,871,438 (Marschman S. C. & Davis N. C.) describes oxygen evolving cermet anodes made by sintering reaction of mixtures of Ni and Fe oxides and NiO with 20 w % powders of metallic Ni+Cu.

WO 2004/082355 (Laurent V. & Gabriel A.) describes oxygen evolving anodes made of a cermet phase corresponding to the formula NiO—$NiFe_2O_4$-M, where M is a metallic phase of Cu+Ni powders containing 3-30% Ni. The metallic phase M represents more than 20 w % of the cermet material.

BRIEF DESCRIPTION OF THE DRAWINGS

The prior art underlying the invention and the invention are hereinafter described by way of example with reference to the accompanying drawings in which.

DISCUSSION OF THE PRIOR ART UNDERLYING THE INVENTION

Figure 1:
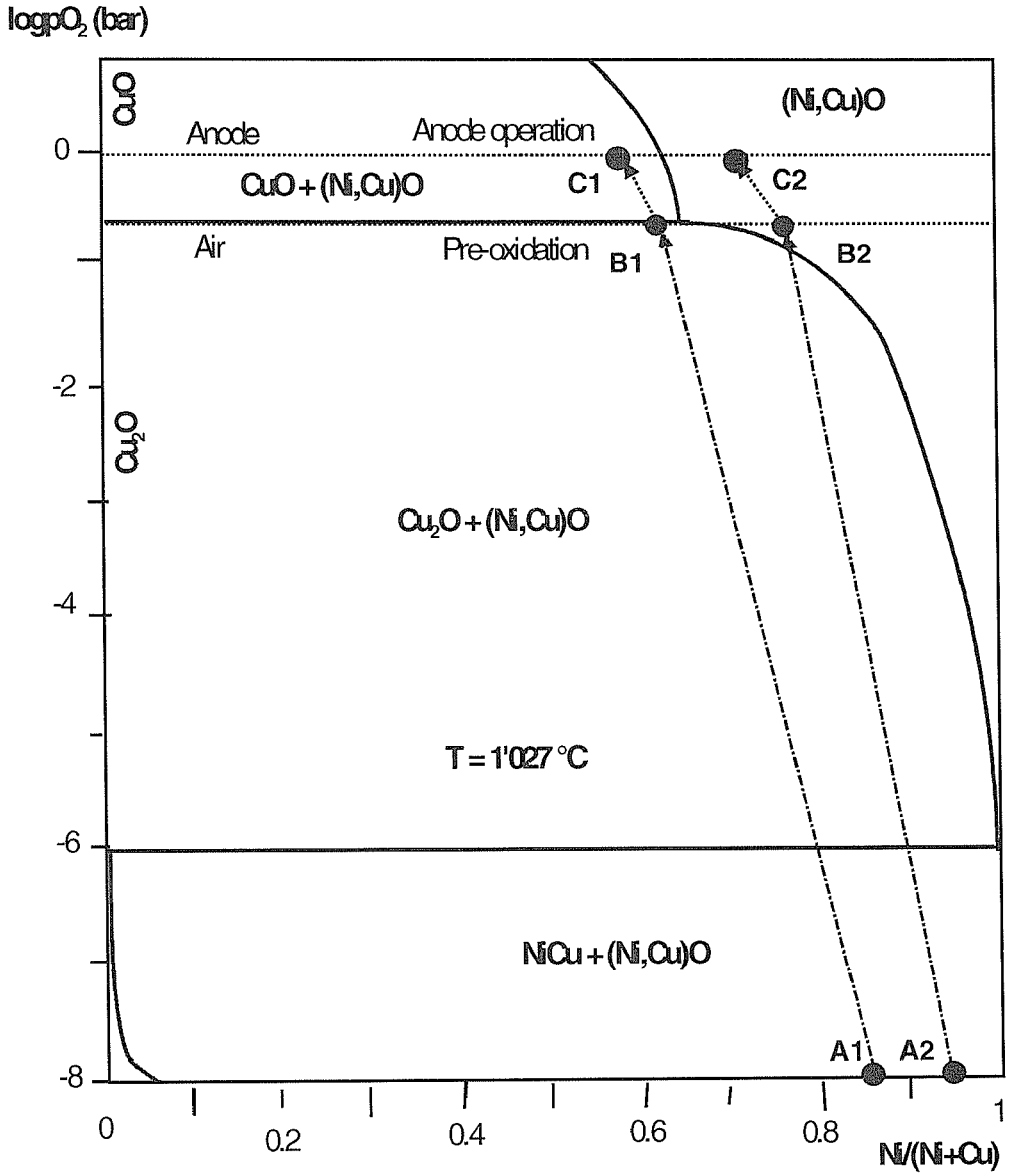
FIG. 1 is a Ni—Cu—O2 phase diagram based on that according to A. E. McHale & R. S. Roth: Phase Equibria Diagrams—Vol. XII (1996), p. 27—FIG. 9827, edited by The American Ceramic Society, Columbus, Ohio—USA.

The oxide active layer on Fe-rich alloys with a nickel content lower than 50 w % (WO 2000/006803 & 2003/078695), contains in predominance a hematite $Fe_2O_3$ phase, which is porous and could not be an oxidation barrier because of the existence of suboxides (FeO, $Fe_3O_4$) that may favour the ionic migration of $O^{2-}$. At high operating temperatures, these Fe-rich anode alloys may be totally oxidized after a relatively short duration. Also these oxygen evolving anodes made of Fe-rich alloys may be severely attacked by the fluoride compounds in a cryolite melt, which may result in severe structure damages due to selective Fe corrosion.

An improvement in oxidation resistance may be obtained by using alloys with a higher nickel content (WO 2004/074549) with a Fe-rich outer part or coating. Again, the hematite $Fe_2O_3$ external layer may not be an effective fluoridation barrier, which would limit the Ni and Fe contents in the anode substrate alloys to respectively 55-60 w % and 30-35 w %; the balance being compensated by Cu in the range of 5-9 w %. The high Cu content in the alloy, or more exactly the high Cu/Ni ratio, may however lead to unstable operation at high current densities (see below).

To improve the fluoridation resistance of oxygen evolving anodes operating in aluminum reduction cells, a CoO external coating may be used (WO 2005/090641, 2005/090642 & 2005/090643). An underneath nickel ferrite oxidation barrier may be obtained by in-situ oxidation of the anode alloy substrate containing 65-85 w % Ni; 5-25 w % Fe; 1-20 w % Cu; 0-10 w % (Si+Al+Mn). Cobalt oxides are characterized by the existence of two reversible forms: the p-semiconductor form CoO is predominant at a temperature higher than 900° C. and/or under low oxygen pressure; at lower temperature and/or under high oxygen pressure an n-semiconductor form $CO_3O_4$ is predominant. The specific composition and pre-oxidation conditions of the Co precursor of the external layer may be used to obtain the desired p-semiconductor form CoO. However at high oxygen activity generated by high current densities (>1.0 A/cm2) a partial transformation of CoO into the n-semiconductor form $CO_3O_4$ may not be avoidable. On the other hand the accumulation of Cu oxides resulting from its outward diffusion may also lead to the formation of the n-semiconductor phase Co3O4 according to the reaction:

$$3CoO+2CuO=Co_3O_4+Cu_2O$$

The presence of the mixture CoO and $CO_3O_4$ may lead to the formation of n-p semiconductor junctions leading to an unstable regime due to a potential barrier of the semiconductor diodes (Schottky effect).

Mixed Ni and Fe oxides that are well known under the designation of nickel ferrite $NiFe_3O_4$ constitute one of the most stable ceramic phases in a cryolite melt. Nickel ferrite may be used as a coating formed on appropriate metallic anode substrate alloys (WO 2005/090642), or as a cermet matrix under the form of a cast envelope (WO 2004/018082) or as massive bodies (WO 2004/082355 & U.S. Pat. No. 4,871,438). Generally the metallic alloys used as precursor of nickel ferrite coating or the cermet materials contain always a certain quantity of Cu or/and Cu alloys (up to about 25 w % Cu). The formation of a (Ni, Cu)O solid solution inhibits anode passivation due to $NiF_2$ or/and NiO formation; also a (Ni, Cu)O solid solution may act as binding agent improving the densification of the Nickel ferrite matrix. However an enrichment of copper due to its outward diffusion combined with the increase of oxygen activity generated by high current density may lead to the formation of a CuO phase by segregation of the (Ni, Cu)O solid solution as shown on FIG. 1.

Phase Diagram Ni—Cu—O:

The phase diagram of the ternary system of nickel, copper and oxygen, illustrated on FIG. 1, presents the existence of different phases as a function of the (Ni/Ni+Cu) atomic ratio of the alloy and at different oxygen pressures.

Starting from a Cu-rich anode alloy Al of composition 65 w % Ni-10 w % Cu-25 w % Fe, pre-oxidation in air (0.2 bar $pO_2$–log $pO_2$=–0.7) leads to an external oxide layer composed of a solid solution of (NI, Cu)O and an excess of $Cu_2O$ (point B1); both are p-semiconductors. Due to outward diffusion of Cu the oxide composition is richer in Cu than that of the base alloy.

When the anode operates at high current density (>1.0 A/cm$^2$) the activity of oxygen adsorbed in the active oxide structure may rise up to 1 bar (log $pO_2$=0), and due to the preferential diffusion of Cu the oxide composition would shift to the left (point C1. The point C1 is situated in the area where the (Ni, Cu)O solid solution is partially decomposed, with formation CuO which is an n-semiconductor.

The active oxide layer would be then composed of a p-semiconductor matrix and local areas of n-semiconductor CuO. The n-p semiconductor junctions would form diodes leading to an unstable cell voltage regime due to the charge potential barrier.

Starting from a Cu-poor anode alloy A2 (for example 65w % Ni-2 w % Cu-33 w % Fe), the pre-oxidation in air (0.2 bar $pO_2$–log $pO_2$=–0.7) leads to the external oxide layer composed of a solid solution of (NI, Cu)O (point B2) which is a p-semiconductor. Due to outward diffusion of Cu the oxide composition is richer in Cu than that of the base alloy.

When the anode operates at high current density (>1.0 A/cm$^2$) the activity of oxygen adsorbed in the active oxide structure may rise up to 1 bar (log $pO_2$=0), and due to the preferential diffusion of Cu the oxide composition would shift to the left (point C2). This point C2 is situated in the stable area of (Ni, Cu)O solid solution, the p-semiconductor character of the active oxide layer would be maintained, then no cell voltage oscillation at high current density. However the simple replacement of Cu by Fe would lead to a preferential oxidation/corrosion of Fe reducing the anode life time.

Figure 2:
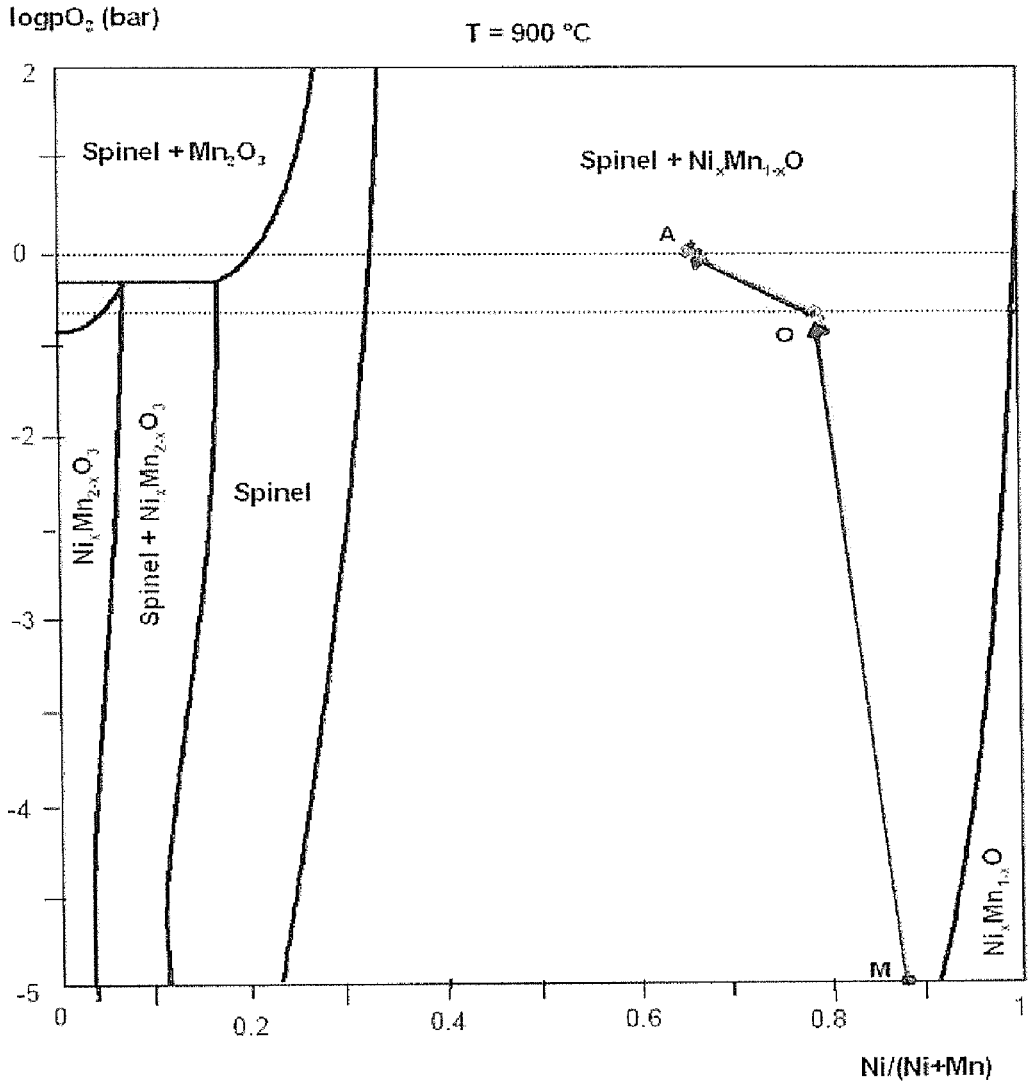
FIG. 2 is a Ni—Mn—O2 phase diagram based on that according to R. S. Roth: Phase Equilibria Diagrams—Vol. XI (1995), p. 11—FIG. 9127, edited by The American Ceramic Society, Columbus, Ohio—USA.

Phase Diagram Ni—Mn—O:

The phase diagram of the ternary system of nickel, manganese and oxygen, illustrated on FIG. 2, presents the existence of different phases as a function of the (Ni/Ni+Mn) atomic ratio of the alloy and at different oxygen pressures.

Starting from an anode alloy M of composition 65 w % Ni-8 w % Mn-27 w % Fe, the pre-oxidation in air (0.2 bar $pO_2$–log $pO_2$=–0.7) leads to an external oxide layer composed of a spinel phase (NiO structure having insertion of Mn atoms) solid solution of $Ni_xMn_{1-x}O$ (point O); both are p-semiconductors. The oxide composition may be richer in Mn than that of the base alloy because of preferential diffusion of Mn.

When the anode operates at high current density (>1.0 A/cm$^2$) the activity of oxygen adsorbed in the active oxide structure may rise up to 1 bar (log $pO_2$=0), and due to the preferential diffusion of Mn the oxide composition would shift to the left (point A).

The area of the spinel phase and the solid solution of $Ni_xMn_{1-x}O$ is stable for a large range of (Ni/Ni+Mn) ratio; therefore the p-semiconductor character of the active oxide layer should be maintained, then the cell voltage should be maintained stable at high current density regime.

In considering the possible modification of the semiconductor character of the active oxide layer under the anode operating conditions, the phase diagrams show clearly the advantages of Ni—Mn—Fe (and low Cu) alloys over Ni—Cu—Fe alloys. The total or partial replacement of Cu in the alloy by Mn should allow to maintain the Ni and Fe contents at the optimal values avoiding Ni passivation (too high Ni content) and/or the preferential Fe oxidation/corrosion (too high Fe content).

SUMMARY OF THE INVENTION

An objective of the present invention is to provide an oxygen evolving substantially inert metallic anode that has an active metallic oxide layer exempt from n-p semiconductor junctions, and is able to operate at high oxygen activity generated by high current densities for example in the range of 1.1 to 1.3 A/cm$^2$.

The anode according to the invention is made of alloys containing principally Nickel-Iron-Manganese-Copper.

According to the invention, there is provided a metallic oxygen evolving anode for electrowinning aluminium by decomposition of alumina dissolved in a cryolite-based molten electrolyte, comprising an alloy consisting essentially of nickel, iron, manganese, optionally copper, and silicon, characterized by the following composition and relative proportions:

| | |
|---|---|
| Nickel (Ni) | 62-68 w % |
| Iron (Fe) | 24-28 w % |
| Manganese (Mn) | 6-10 w % |
| Copper (Cu) | 0-0.9 w % |
| Silicon (Si) | 0.3-0.7 w % |

and possibly other trace elements such as carbon in a total amount up to 0.5 w % and preferably no more that 0.2 wt % or even 0.1 w %, wherein the weight ratio Ni/Fe is in the range 2.1 to 2.89, preferably 2.3 to 2.6, the weight ratio Ni/(Ni+Cu) is greater than 0.98, the weight ratio Cu/Ni is less than 0.01, and the weight ratio Mn/Ni is from 0.09 to 0.15.

When copper is present it is preferably in an amount of at least 0.1 w %. possibly at least 1 w % or 2 w % or 3 w %, and its upper limit is 0.9 w % or preferably 0.7 w %. An optimum amount of copper is about 0.5 w %.

Preferably, the alloy is composed of 64-66 w % Ni; Iron; 25-27 w % Fe; 7-9 w % Mn; 0-0.7 w % Cu; and 0.4-0.6 w % Si. A most preferred composition is about 65 w % Ni; 26.5 w % Fe; 7.5 w % Mn; 0.5 w % Cu and 0.5 w % Si.

The alloy surface can have an oxide layer comprising a solid solution of nickel and manganese oxides (Ni,Mn)Ox and/or nickel ferrite, produced by pre-oxidation of the alloy. The alloy, optionally with a pre-oxidised surface, can advantageously be coated with an external coating comprising cobalt oxide CoO.

The invention also provides an aluminium electrowinning cell comprising at least one anode, as defined above, immersible in a fluoride-containing molten electrolyte that is typically at a temperature of 870-970° C., in particular 910-950° C.

Another aspect of the invention is a method of producing aluminium in such a cell, comprising passing electrolysis current between the anode and a cathode immersed in the fluoride-containing molten electrolyte to evolve oxygen at the anode surface and reduce aluminium at the cathode. In this method, current can be passed at an anode current density of at least 1 A/cm2, in particular at least 1.1 or at least 1.2 A/cm2.

DETAILED DESCRIPTION

The partial or total or almost total replacement of copper in conventional alloys by manganese should lead to the following advantages that can be derived from FIG. 2: Mn should inhibit the anode passivation due to $NiF_2$ and/or NiO by formation of an (Ni, Mn)O solid solution or spinel phase.

The p-semiconductor (Ni, Mn)O solid solution or spinel that is stable at high oxygen activity should not then lead to any segregation with formation of n-semiconductor phase at high current density.

The inventive composition range and ratios of the anode alloy is determined according to the following criteria:

The (Ni/Fe) mass ratio should be higher than 2.10 to favour the formation of mixed oxides of Ni ferrite type. This mass ratio should be lower than 2.89 to inhibit anode passivation due to $NiF_2$ or/and NiO formation. The preferred (Ni/Fe) mass ratio is about 2.45.

The Cu content is defined by a (Ni/(NI+Cu)) ratio higher than 0.98, or a (Cu/Ni) mass ratio lower than 0.01, to suppress the formation of CuO by segregation of (Ni, Cu)O solid solution at high oxygen activity (see FIG. 1).

The (Mn/Ni) mass ratio should be higher than 0.09 and lower than 0.15 to preserve the oxidation resistance of Ni based alloys.

The absolute Ni content should be on the range of 62 to 68 w %.

The composition range of the anode alloys should be 62-68 w % Ni; 24-28 w % Fe; 6-10 w % Mn; 0.01-0.9 w % Cu; 0.3-0.7 w % Si.

The preferred alloy composition is about 65 w % Ni; 26.5 w % Fe; 7.5 w % Mn; 0.5 w % Cu; 0.5 w % Si.

A direct pre-oxidation treatment of the anode structure at 930-980° C. in an oxidizing atmosphere should lead to the formation of an active mixed oxide layer of Ni ferrite type.

The anode can be used also with an external Co oxide coating without any undesirable diffusion-chemical interaction of the alloy components.

Figure 3A:
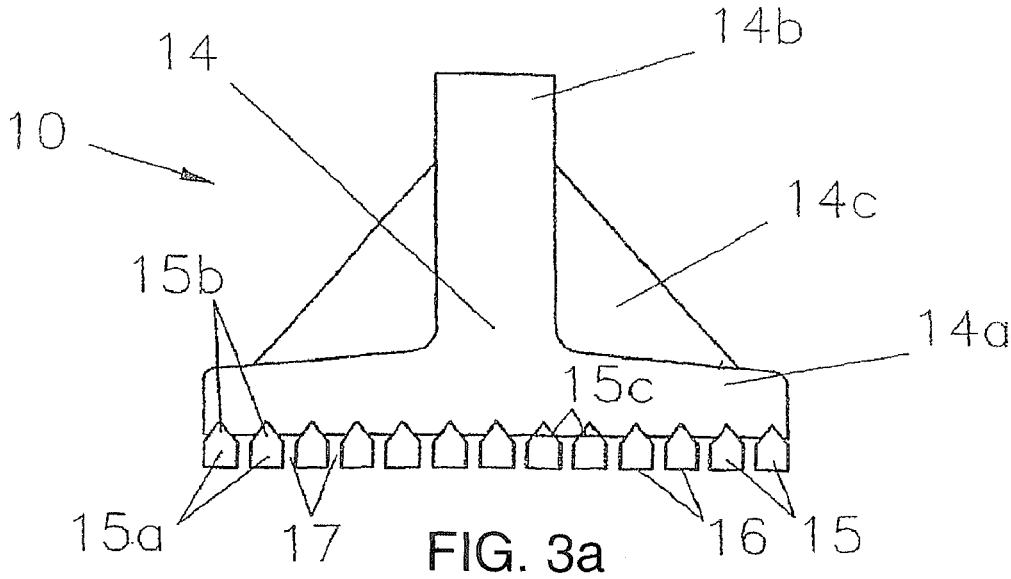
FIGS. 3*a* and 3*b* schematically show respectively a side elevation and a plan view of an anode for use in a cell according to the invention.
Figure 3B:
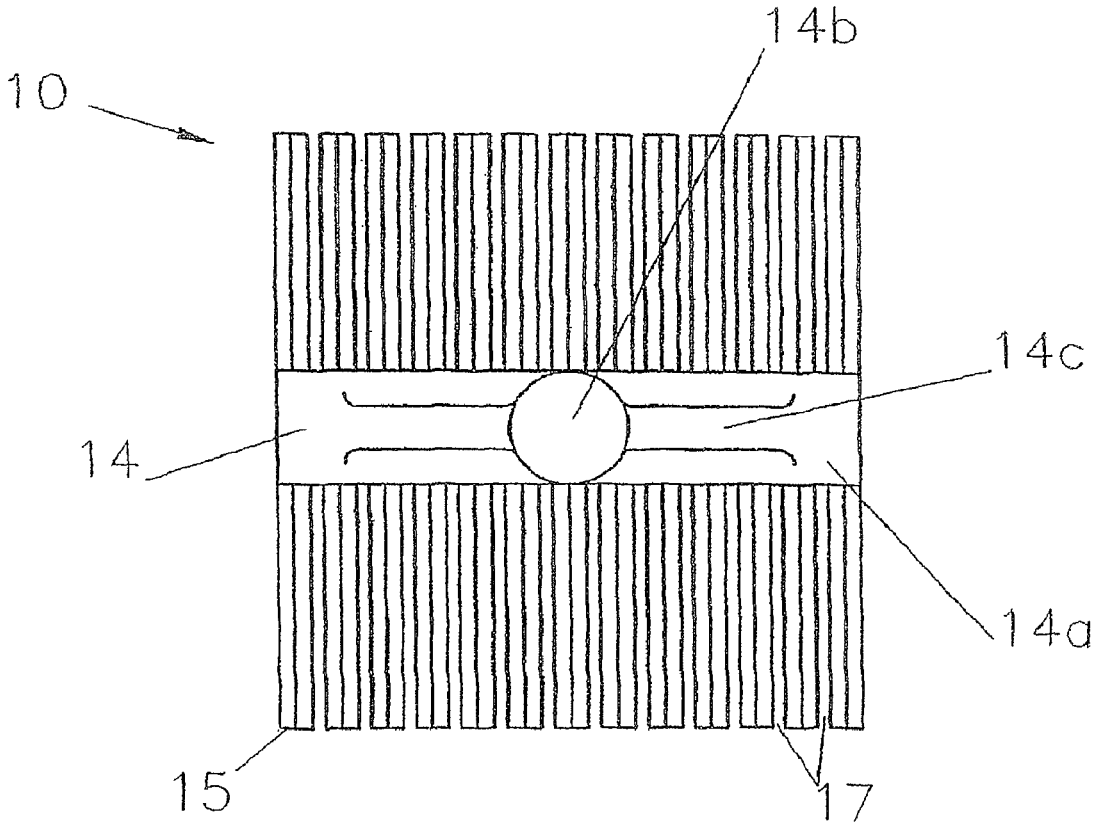

FIGS. 3*a* and 3*b* schematically show an anode 10, whose structure is known from WO 2004/074549, which can be used in a cell for the electrowinning of aluminium according to the invention.

In this example, the anode 10 comprises a series of elongated straight anode members 15 connected to a cast or profiled support 14 for connection to a positive bus bar. The cast or profiled support 14 comprises a lower horizontally extending foot 14*a* for electrically and mechanically connecting the anode members 15, a stem 14*b* for connecting the anode 10 to a positive bus bar and a pair of lateral reinforcement flanges 14*c* between the foot 14*a* and stem 14*b*.

The anode members 15 may be secured by force-fitting or welding the foot 14*a* on flats 15*c* of the anode members 15. As an alternative, the connection between the anode members 15 and the corresponding receiving slots in the foot 14*a* may be shaped, for instance like dovetail joints, to allow only longitudinal movements of the anode members.

The anode members 15 for example have a bottom part 15*a* which has a substantially rectangular cross-section with a constant width over its height and which is extended upwardly by a tapered top part 15*b* with a generally triangular cross-section. Each anode member 15 has a flat lower oxide surface 16 that is electrochemically active for the anodic evolution of oxygen during operation of the cell.

According to this invention, the anode members 15, in particular their bottom parts 15*a*, are made of an alloy of nickel, iron, manganese, copper and silicon as described herein. The lifetime of the anode may be increased by a protective coating made of cerium compounds, in particular cerium oxyfluoride.

In this example, the anode members 15 are in the form of parallel rods in a coplanar arrangement, laterally spaced apart from one another by inter-member gaps 17. The inter-member gaps 17 constitute flow-through openings for the circulation of electrolyte and the escape of anodically-evolved gas released at the electrochemically active surfaces 16.

FIGS. 2*a* and 2*b* show an aluminium electrowinning cell, also known from WO 2004/074549, having a series of metal-based anodes 10 in a fluoride-containing cryolite-based molten electrolyte 5 containing dissolved alumina.

The electrolyte 5 can for example have a composition that is selected from Table 1 below, known from WO 2004/074549:

TABLE 1

| | $AlF_3$ | NaF | KF | $CaF_2$ | $Al_2O_3$ | T ° C. |
|---|---|---|---|---|---|---|
| A1 | 41 | 45 | 2.5 | 2.5 | 9 | 948° |
| B1 | 39.2 | 43.8 | 5 | 2 | 10 | 945° |
| C1 | 40.4 | 44.1 | 4 | 2 | 9.5 | 940° |
| D1 | 39.6 | 42.9 | 5 | 3 | 9.5 | 935° |
| E1 | 39 | 41.5 | 6.5 | 3.5 | 9.5 | 930° |
| F1 | 42 | 42 | 5 | 2 | 9 | 925° |
| G1 | 41.5 | 41.5 | 5 | 3 | 9 | 915° |
| H1 | 36 | 40 | 10 | 4 | 10 | 910° |
| I1 | 34 | 39 | 13 | 4 | 10 | 900° |

For instance, the electrolyte consists of: 7 to 10 weight % dissolved alumina; 36 to 42 weight % aluminium fluoride, in particular 36 to 38 weight %; 39 to 43 weight % sodium fluoride; 3 to 10 weight % potassium fluoride, such as 5 to 7 weight %; 2 to 4 weight % calcium fluoride; and 0 to 3 weight % in total of one or more further constituents. This corresponds to a cryolite-based ($Na_3AlF_6$) molten electrolyte containing an excess of aluminium fluoride ($AlF_3$) that is in the range of about 8 to 15 weight % of the electrolyte, in particular about 8 to 10 weight %, and additives that can include potassium fluoride and calcium fluoride in the abovementioned amounts.

The anodes 10 can be similar to the anode shown in FIGS. 1*a* and 1*b*. Alternatively the anodes can be vertical or inclined. Suitable alternative anode designs are disclosed in the abovementioned references. The anodes can also be massive bodies without gas-escape openings.

In this example, the drained cathode surface 20 is formed by tiles 21A which have their upper face coated with an aluminium-wettable layer. Each anode 10 faces a corresponding tile 21A. Suitable tiles are disclosed in greater detail in WO02/096830 (Duruz/Nguyen/de Nora).

Tiles 21A are placed on upper aluminium-wettable faces 22 of a series of carbon cathode blocks 25 extending in pairs arranged end-to-end across the cell. As shown in FIGS. 2*a* and 2*b*, pairs of tiles 21A are spaced apart to form aluminium collection channels 36 that communicate with a central aluminium collection groove 30.

The central aluminium collection groove 30 is located in or between pairs of cathode blocks 25 arranged end-to-end across the cell. The tiles 21A preferably cover a part of the groove 30 to maximise the surface area of the aluminium-wettable cathode surface 20.

The cell can be thermally sufficiently insulated to enable ledgeless and crustless operation.

The illustrated cell comprises sidewalls 40 made of an outer layer of insulating refractory bricks and an inner layer of carbonaceous material exposed to molten electrolyte 5 and to the environment thereabove. These sidewalls 40 are protected against the molten electrolyte 5 and the environment thereabove with tiles 21B of the same type as tiles 21A. The cathode blocks 25 are connected to the sidewalls 40 by a peripheral wedge 41 which is resistant to the molten electrolyte 5.

Furthermore, the cell is fitted with an insulating cover 45 above the electrolyte 5. This cover inhibits heat loss and maintains the surface of the electrolyte in a molten state. Further details of suitable covers are for example disclosed in WO 2003/02277.

Figure 4A:
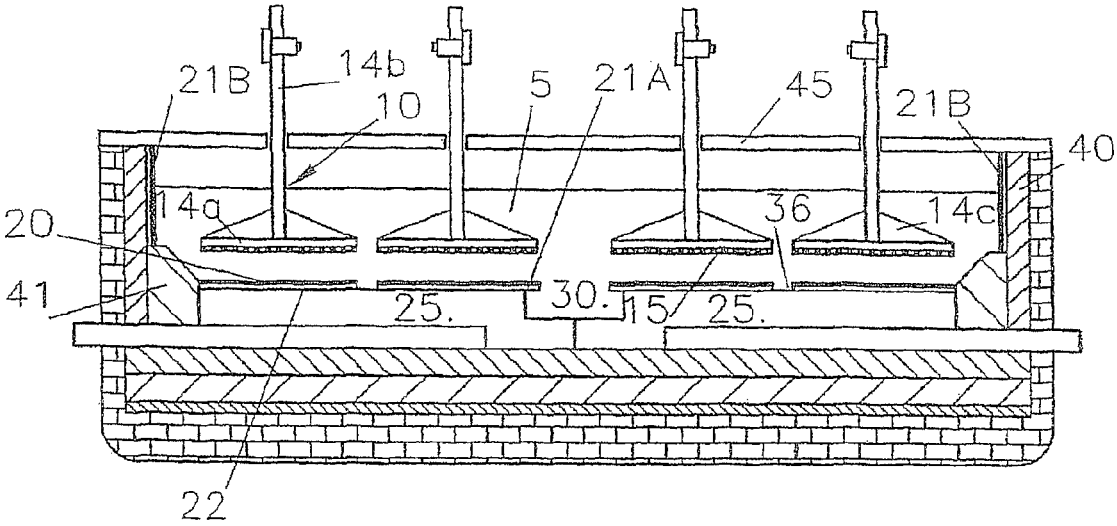
FIGS. 4*a* and 4*b* show a schematic cross-sectional view and a plan view, respectively, of an aluminium production cell with a fluoride-containing electrolyte and a metallic oxygen evolving anode according to the invention.
Figure 4B:
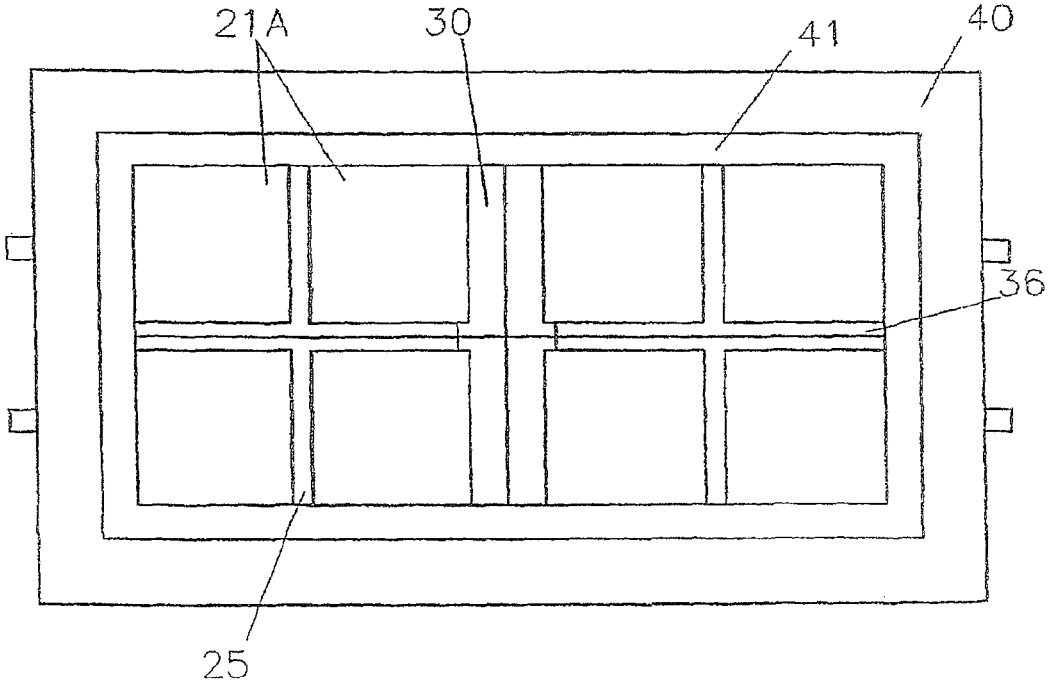

In operation of the cell illustrated in FIGS. 4*a* and 4*b*, alumina dissolved in the molten electrolyte 5 at a temperature for example of 880° to 940° C. is electrolysed between the anodes 10 and the cathode surface 20 to produce oxygen gas on the operative anodes surfaces 16 and molten aluminium on the aluminium-wettable drained cathode tiles 21A. The cathodically-produced molten aluminium flows on the drained cathode surface 20 into the aluminium collection channels 36 and then into the central aluminium collection groove 30 for subsequent tapping.

The invention will be further described in the following Examples as well as with reference to a Comparative Example.

Example 1

A metallic alloy of composition 65.0+/−0.5 w % nickel; 7.5+/−0.5 w % manganese; 0.5+/−0.1 w % copper; 0.5+/−0.1 w % silicon; <0.01 w % carbon and balance iron was prepared by investment casting as follow:

- A load of about 5 kg of alloy is prepared by mixing the different metallic components (except carbon) accordingly to the indicated nominal composition.
- The mixture is melted under vacuum in graphite crucible having a ceramic lining, at 1'500° C. corresponding to an over-heat of about 50° C. The molten metal mass was kept at this temperature, under vacuum during about 10 minutes to complete the degassing.
- Several moulds, made of a ceramic mixture, having a cylindrical form of 20 mm diameter and 250 mm length with one dead-end, were preheated at 700° C. in the same vacuum chamber.
- The moulds were filled completely with the liquid metal; the pouring operation was done in the vacuum chamber, within 10 minutes.
- The cast specimens were allowed to solidify under vacuum before removing to ambient atmosphere to achieve natural cooling during a few hours.

After cooling the metal alloy rods were removed from the moulds: at the pouring extremity a funnel was formed along the cylinder axis due to the metal contraction. As the sample portion corresponding to the pouring extremity might present some porosity, it was eliminated for recycling. The alloy rods were then sandblasted to remove traces of the ceramic mould.

The final alloy rod samples presented uniform gray metallic surfaces, without any oxidation trace or defect. Examination of the etched cross section showed a dense and uniform solid solution structure without any segregation precipitation, the crystallization grain sizes were on the range of 0.5 to 1.0 cm. The quantitative control analysis, by SEM (scanning electronic microscope), confirmed the desired nominal composition of the alloy; with an experimental density of 8.5 g/cm$^3$.

Example 2

An anode sample of 20 mm diameter and 20 mm; length was prepared from the alloy rod of nominal composition of 65 w % Ni-26.5 w % Fe; 7.5 w % Mn; 0.5 w % Cu; 0.5 w % Si as described in Example 1. After sandblasting the sample was pre-oxidized in air, at 930° C. during 12 hours, the heating rate was controlled at 300° C./h. After pre-oxidation the sample was allowed to cool down to room temperature in the furnace during 12 hours.

The final oxidized sample presented uniform black-grey surfaces, without any cracks. The examination of the cross section showed an adherent and uniform oxide scale of 45 to 55 microns of thickness. SEM analysis of the oxide scale showed an average metallic composition of 25 w % Ni; 9 w % Mn; 60 w % Fe (Cu, Si non detectable), which should correspond to (Ni, Mn) ferrite of formula $Ni_{0.73}Mn_{0.27}Fe_2O_4$. The higher Mn and Fe contents in the oxide phase should be due to the outward Mn diffusion and the preferential oxidation of Fe.

Example 3

An aqueous plating bath was prepared according to the following composition:

| | |
|---|---|
| $CoSO_4$•7 $H_2O$: | 80 g/litre |
| $NiSO_4$•6 $H_2O$: | 40 g/litre |
| $HBO_3$: | 15 g/litre |
| KCl: | 15 g/litre |
| pH: | 4.5 (adjusted with $H_2SO_4$) |

The plating solution was maintained at 18-20° C. by a cooling circuit. Two separate counter-electrodes made of pure Co and Ni—S 10% were connected to 2 rectifiers.

An anode sample, with nominal composition of 65 w % Ni; 26.5 w % Fe; 7.5 w % Mn; 0.5 w % Cu; 0.5 w % Si, was prepared and sandblasted as in Example 2. Just before immersion in the plating bath, the anode was etched in 20% HCl solution during 6 minutes, then rinsed with deionised water. The specimen was placed in the plating tank; the negative outputs of the 2 rectifiers were connected to the sample contact. Currents of 0.64 A and 0.16 A were adjusted respectively with the Co anode and Ni anode rectifiers; this corresponded to a total current of 0.8 A, or 40 mA/cm$^2$ on the alloy sample to be coated, and an anode dissolution proportion of 80% Co-20% Ni (desired coating composition). The plating operation was performed at constant current and temperature during 3 hours, under good agitation.

After plating, the total weight gain was 2.5 g, corresponding to a deposition efficiency of 99% and an average thickness of 150-160 microns. SEM analysis of the deposit confirmed a composition range of 18-20 w % Ni and 80-82 w % Co.

The coated anode was pre-oxidized in air, at 930° C. during 8 hours; the heating rate is controlled at 300° C./h. After oxidation the sample was removed at the 930° C. temperature from the furnace to allow a flash cooling to ambient temperature. The oxidized sample presented a uniform dark gray surface, without any crack or blister. Examination of the cross section showed an oxidation depth of about ½ of the initial coating thickness; SEM analysis showed an average metallic composition of the oxide scale of 78 to 80 w % Co; 18 to 20 w % Ni-2 to 2.5 w % Mn—Fe and Cu non detectable.

Example 4

A pre-oxidized sample of nominal alloy composition 65 w % Ni; 26.5 w % Fe; 7.5 w % Mn; 0.5 w % Cu; 0.5 w % Si as described in Example 2 was used as oxygen evolving inert anode in an aluminum reduction test cell containing 1.5 kg of cryolite based melt having 11 w % AlF3 in excess, 7 w % KF and 9.5 w % $Al_2O_3$. A cylindrical graphite crucible having a lateral lining made of a dense alumina tube was used as electrolysis cell; the cathode was constituted by a liquid aluminum pool, about 2 cm deep, placed on the cell bottom. The bath temperature was maintained and controlled by an external electrical furnace at 930+/−5° C. The $Al_2O_3$ consumption was compensated by an automatic feeding corresponding to 65% of the theoretic value. The test current was maintained constant at 10.8 A, corresponding to an average current density of 1.2 A/cm$^2$ based on the effective active surfaces of the test anode (bottom surface+½ lateral surfaces).

The cell voltage recording during the test period of 200 hours showed a stable regime at 4.1+/−0.1 volts, except for a short period of temperature loss due to the addition of fresh powders for bath chemistry adjustment.

After 200 hours the anode was removed from the cell for examination. The anode was covered by a oxide scale of about 1 mm thickness, with some solid bath inclusions. The oxide scale was rather rough with dispersed nodules of 2-4 mm diameter, but no crack or defect was observed.

Example 5

Comparative Example

An anode sample of 20 mm diameter and 20 mm length was prepared from an alloy rod having nominal composition of 65 w % Ni; 24.5 w % Fe; 10 w % Cu; 1.5 w % (Mn+Si). The sample was sandblasted and pre-oxidized as in Example 2.

The pre-oxidized sample was used as oxygen evolving inert anode in aluminum reduction cell as described in Example 4. The test current was maintained constant at 9.0 A, corresponding to an average current density of 1.0 A/cm$^2$ based on the effective active surfaces of the test anode (bottom surface+½ lateral surfaces).

The cell voltage recording during the test period of 200 hours showed relatively stable intervals at 4.0+/−0.1 volts; however short periodic cell voltage oscillation regimes of 6 to 24 hours were observed after 15, 55 and 90 hours etc. The amplitude of the voltage oscillations was between 4 and 8 volts, with a frequency of 2 to 4 minutes.

The cell voltage oscillation is presumed to correspond to the charge-discharge cycle of semiconductor diodes of n-p junctions, due to the formation of the n-semiconductor phase CuO resulting from Cu diffusion and the high oxygen activity generated at high current density (see FIG. 1).

The invention claimed is:

1. A metallic oxygen evolving anode for electrowinning aluminium by decomposition of alumina dissolved in a fluoride-containing molten electrolyte, comprising an alloy consisting essentially of nickel, iron, manganese, optionally copper, and silicon, characterized by the following composition and relative proportions:

| | |
|---|---|
| Nickel (Ni) | 62-68 w % |
| Iron (Fe) | 24-28 w % |
| Manganese (Mn) | 6-10 w % |
| Copper (Cu) | 0-0.9 w % |
| Silicon (Si) | 0.3-0.7 w %, |

and possibly other trace elements in a total amount up to 0.5w %, wherein:

the weight ratio Ni/Fe is in the range 2.1 to 2.89, the weight ratio Ni/(Ni+Cu) is greater than 0.98, the weight ratio Cu/Ni is less than 0.01, and the weight ratio Mn/Ni is from 0.09 to 0.15.

2. The anode of claim 1 wherein the alloy is composed of

| | |
|---|---|
| Nickel (Ni) | 64-66 w % |
| Iron (Fe) | 25-27 w % |
| Manganese (Mn) | 7-9 w % |
| Copper (Cu) | 0-0.7 w % |
| Silicon (Si) | 0.4-0.6 w %. |

3. The anode of claim 2 wherein the alloy is composed of about

| | |
|---|---|
| Nickel (Ni) | 65 w % |
| Iron (Fe) | 26.5 w % |
| Manganese (Mn) | 7.5 w % |
| Copper (Cu) | 0.5 w % |
| Silicon (Si) | 0.5 w %. |

4. The anode of claim 2 wherein the alloy surface has an oxide layer comprising a solid solution of nickel and manganese oxides $(Ni,Mn)O_x$.

5. The anode of claim 4 wherein the alloy surface has an oxide layer comprising nickel ferrite.

6. The anode of claim 1 wherein the alloy surface has an oxide layer comprising a solid solution of nickel and manganese oxides $(Ni,Mn)O_x$.

7. The anode of claim 1 wherein the alloy surface has an oxide layer comprising nickel ferrite.

8. The anode of claim 1 wherein the alloy, optionally with a pre-oxidised surface, is coated with an external coating comprising cobalt oxide CoO.

9. An aluminium electrowinning cell comprising at least one anode, as claimed in claim 1, immersible in a fluoride-containing molten electrolyte contained in the cell.

10. The cell of claim 9 wherein the molten electrolyte is at a temperature of 870-970° C.

11. The cell of claim 10 wherein the molten electrolyte is at a temperature of 910-950° C.

12. A method of producing aluminium in a cell as claimed in claim 9 comprising passing electrolysis current between the anode and a cathode immersed in the fluoride-containing molten electrolyte to evolve oxygen at the anode surface and reduce aluminium at the cathode.

13. The method of claim 12 wherein the current is passed at an anode current density of at least 1A/cm2.

14. The method of claim 13 wherein the current is passed at an anode current density of at least 1.1A/cm2.

15. The method of claim 13 wherein the current is passed at an anode current density of at least 1.2A/cm2.

16. The anode of claim 1 wherein the alloy has a weight ratio Ni/Fe is in the range 2.3 to 2.6.

* * * * *